US005880391A

United States Patent [19]

Westlund

[11] Patent Number: 5,880,391

[45] Date of Patent: Mar. 9, 1999

[54] CONTROLLER FOR USE WITH A MUSIC SEQUENCER IN GENERATING MUSICAL CHORDS

[76] Inventor: Robert L. Westlund, 39424 258th Ave. SE., Enumclaw, Wash. 98022

[21] Appl. No.: 978,664

[22] Filed: Nov. 26, 1997

[51] Int. Cl.[6] ..... G10H 1/38; G10H 1/40

[52] U.S. Cl. ..... 84/645; 84/650; 84/652; 84/DIG. 12; 84/DIG. 22

[58] Field of Search ..... 84/609–614, 634–638, 84/645, 649–652, 666–669, DIG. 12, DIG. 22

[56] References Cited

U.S. PATENT DOCUMENTS

| | | | |
|---|---|---|---|
| 3,962,945 | 6/1976 | Creager et al. . | |
| 4,129,055 | 12/1978 | Whittington et al. . | |
| 4,226,154 | 10/1980 | Easler . | |
| 5,166,467 | 11/1992 | Brown . | |
| 5,223,655 | 6/1993 | Watanabe et al. . | |
| 5,250,746 | 10/1993 | Saito et al. . | |
| 5,266,735 | 11/1993 | Shaffer et al. | 84/609 |
| 5,430,244 | 7/1995 | Ruffcorn . | |
| 5,440,071 | 8/1995 | Johnson | 84/637 |
| 5,481,066 | 1/1996 | Kitamura . | |
| 5,502,274 | 3/1996 | Hotz . | |
| 5,565,641 | 10/1996 | Gruenbaum | 84/645 X |
| 5,639,980 | 6/1997 | Imaizumi . | |

*Primary Examiner*—Stanley J. Witkowski
*Attorney, Agent, or Firm*—Jensen & Puntigam, P.S.

[57] ABSTRACT

The controller scans a plurality of chord switches which select a particular type of chord. If a previously operated selection switch is still closed, the previously generated MIDI chord message continues. If a selection switch is newly operated, then the MIDI signals from an associated musical instrument on a selected channel are scanned to determine the presence of a particular note meeting pre-selected criteria. When such a note is recognized, a three-note MIDI chord message using the particular note as the root note in the chord is produced and transmitted to the music sequencer, which produces a musical pattern in the particular chord as an accompaniment to the musical instrument.

10 Claims, 4 Drawing Sheets

ROOT NOTE CHARACTER

80
DOES UART HAVE A CHAR ?
NO
YES
82
CHAR_IN
84
TEST PREVIOUS CHAR.
YES
NO
90
IS VALUE OF CURRENT CHAR.WITHIN BASS NOTE RANGE ?
YES
NO
86
TEST CURRENT CHAR. ?
NO
YES
88
CHAR_SV
96
ROOT_VALID 0
MIDI_SV 0
92
ROOT_VALID 1
MIDI_SV
94
RETURN TO MAIN PROGRAM

MIDI_CLOCK

100
IS PRESTOP =0 ?
YES
NO
102
TRANSMIT MIDI CLOCK MESSAGE
104
DECREM MEASURE COUNT
106
IS MEASURE COUNT > 0 ?
YES
NO
108
IS PRESTOP =1 ?
YES
NO
110
TRANSMIT MIDI STOP CODE AND MIDI ALL NOTES OFF CODE
112
PRESTOP ← 0
STOP ← 0
START ← 0
116
IS STOP =1 ?
YES
NO
PRESTOP ← 1
MEASURE_COUNT ← 24
118
120
START ← 0
STOP ← 1
MEASURE_COUNT ← 96
RETURN TO MAIN PROGRAM

CONTROLLER FOR USE WITH A MUSIC SEQUENCER IN GENERATING MUSICAL CHORDS

TECHNICAL FIELD

This invention relates generally to the field of music sequencers which are responsive to MIDI (music instrument digital interface) control signals, and more particularly concerns a specialized controller apparatus for use with such music sequencers.

BACKGROUND OF THE INVENTION

Music sequencers are well-known devices which generate musical accompaniment for a performer. Such devices often include pre-programmed musical sequences which are generated by the sequencer in response to various control switches or the like on the device itself. Other, more sophisticated, sequencers include such a capability but are also capable of receiving control signals from other musical instruments and/or controller devices to produce selected musical accompaniment.

As indicated above, many music sequencers operate with MIDI control signals. The MIDI signals are generated and used in accordance with a known set of format specifications. If a particular music sequencer is capable of operating with MIDI signals, that sequencer can communicate and operate with other MIDI devices from other manufacturers.

Some music sequencers, in response to musical notes in MIDI format generated by a musical instrument, are capable of recognizing certain combinations of such notes as musical chords, and in addition to actually producing the notes, are further capable of producing musical patterns based upon those chords as accompanying music. In operation, such sequencers search for particular three or four note combinations which comprise a musical chord, in the stream of notes provided to it by the musical instrument. In such a case, the sequencer will adjust the notes of the musical pattern it produces to harmonize with the musical notes provided by the musical instrument. The adjustment is accomplished quite rapidly, so that it appears that the change in the accompaniment occurs simultaneously with the playing of the musical notes by the performer on the musical instrument.

Keyboard instruments are frequently used for the above-described musical notes, because they are widely used by performers and also because a keyboard can typically be readily adapted to produce the required MIDI signals. One such instrument is the accordion. Other instruments, including a guitar, could be used. In a typical arrangement, an accordion will use three MIDI channels (1, 2 and 4 herein) to communicate with the music sequencer, with channel one being for the musical notes from the right-hand keyboard of the accordion, channel two for notes from the left-hand bass buttons, and channel four for the left-hand chord buttons. In typical operation, the melody of the musical piece will be played on the right-hand keys of the accordion while the bass and the chord portions of the music will be played with the left hand on the left side bass and chord buttons.

On the accordion, the chord buttons on the left-hand side of the instrument are well suited for producing the control signals necessary for a music sequencer, since operation of each chord button will produce a corresponding three-note chord in conventional MIDI format. However, with typical accordion musical pieces, the chord buttons are normally played after the start of a music measure. For accompaniment, the sequencer requires the MIDI signals to be present at the beginning of a musical measure, which is the normal time for a chord change. Thus, normal use of the chord buttons on an accordion will not be in proper time for the generation of desired chords by the music sequencer at the start of a music measure. There have been attempts to remedy this by playing the accordion chord buttons at the beginning of a music measure or by using foot pedals to produce the desired MIDI signals at the beginning of the measure; however, such techniques have proven to be both difficult to master for a performer and often produce less than desirable results.

It would be hence desirable to have a system which uses conventional keys, buttons or other features of a musical instrument in such a way that the required MIDI control signals are produced for the generation of chord accompaniment (or chord changes) by the music sequencer at the start of a music measure.

DISCLOSURE OF THE INVENTION

Accordingly, the present invention is a controller apparatus for generating MIDI chord signals for use by a music sequencer apparatus, comprising: music instrument means for producing, in MIDI format, a plurality of musical notes selected by an operator for use in producing a desired chord for accompaniment music; means for selecting a type of chord to be generated and for producing a selection signal representing the selected chord type; means responsive to the selection signal and a valid chord root musical note from said plurality of musical notes, said valid root musical note being generated no earlier than the selection signal, to produce a MIDI message representing a preselected desired chord which has the valid musical note as a root note; and means for transmitting the MIDI message to a music sequencer apparatus for generation of a selected musical pattern in the desired chord as an accompaniment to the musical instrument.

BEST MODE FOR CARRYING OUT THE INVENTION

Figure 1:
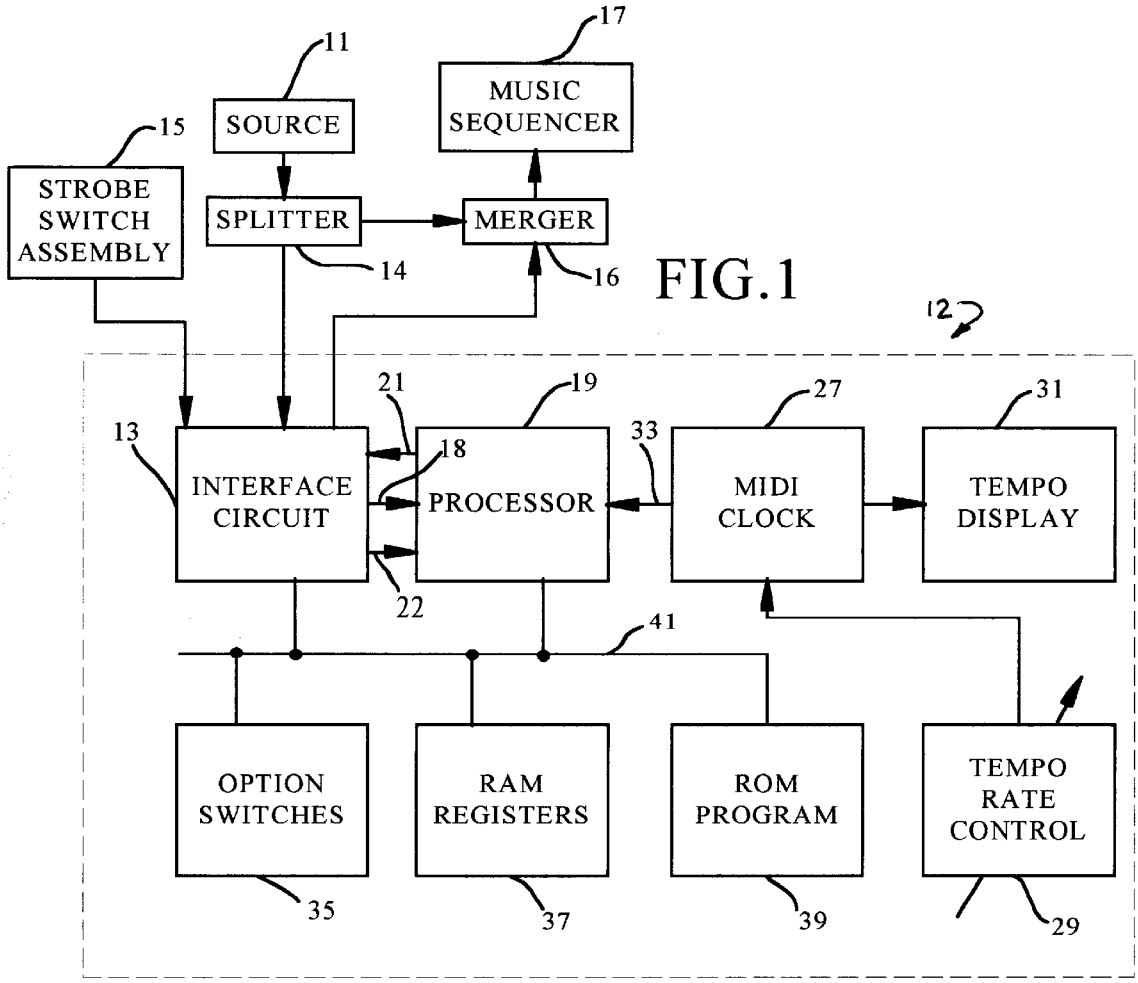
FIG. 1 is a block diagram showing generally the system of the present invention.

FIG. 1 shows the basic structure of the music sequencer controller of the present invention. Interface circuit 13 is responsive to two input signals from external devices and produces/transmits one output signal which is applied to an external device, such as a music sequencer. One input comprises control signals, in MIDI (music instrument digital interface) format, from a source device which produces MIDI signals capable of controlling the general operation of the sequencer. This source device, shown at 11, could be a musical instrument, such as for instance an accordion, piano, guitar or other instrument which is designed to have a MIDI signal output. In the embodiment of FIG. 1, the MIDI signal from source device 11 is applied to a MIDI "splitter" 14 which is a conventional active device for generating two identical sets of MIDI signals from one input set, one set of which is applied to interface 13, the other of which is applied to a MIDI "merger" device 16, which "merges" MIDI signals from source 11 and MIDI signals generated by the apparatus of the present invention 12 applied through interface circuit 13, to sequencer 17.

The second input to interface circuit 13 comprises strobe signals which are generated by an operator-activated strobe switch assembly 15. The strobe switch assembly 15 is typically a foot-operated apparatus having a number of individual selection switches, with one switch for each general type of chord, i.e. major, minor, seventh or other general chord to be transmitted to the sequencer 17 under control of the apparatus of the present invention. Alternatively, a single switch could be used with the pedal moved in different directions to produce the different chords.

The output signals from interface circuit 13, in MIDI format, are transmitted to the MIDI merger device 16 in conjunction with MIDI signals from splitter 14 and then to music sequencer 17 to control the operation of the music sequencer. Music sequencer 17 may be any music sequencer capable of producing and processing MIDI format signals. As indicated above, the MIDI signals to music sequencer 17 include MIDI signals directly from source device 11 (through the merger device 16), as well as additional MIDI signals necessary to generate the selected chords from interface circuit 13 of the present invention.

A fundamental purpose of the present invention is to generate MIDI signals which represent a complete desired chord when strobe switch assembly 15 is operated and a valid root note of the desired chord is detected in the stream of MIDI signals from MIDI source device 11. This invention thus has a significant use with MIDI source devices (such as an accordion) which include a keyboard or similar system to play the melody, and a plurality of additional single buttons or keys such as the left-hand bass buttons. A full chord message is sent to the music synthesizer for the accompaniment music.

It should be understood that the strobe switch 15 is used to define, i.e. select, the particular type of code desired. Of the numerous types of chords, major chord, major 7th chord, minor and minor 7th chords typically comprise the minimum necessary for popular music. Other chords could be produced by adding additional selection switches to the strobe switch assembly.

Basically, the individual selection switches comprising strobe switch assembly 15 are used to initiate a particular type of chord, i.e. to make a chord change, in the accompaniment music produced by music sequencer 17, usually at the start of a music measure. Typically, operation of a selection switch to coincide with the start of a music measure is not very difficult for an experienced musician, since it is natural for a musician to tap one foot in time with music, typically on the first "beat" note of each music measure. It is certainly possible, however, that a chord change can be initiated at other points in the music measure.

In general operation of the apparatus of the present invention, following operation of one selection switch in switch assembly 15 (or the movement of a single pedal to a particular position), MIDI signals from source 11 produced in response to certain buttons being operated are applied (on line 18) to and scanned by processor 19, until a particular note is recognized by its MIDI code as a note belonging to the particular MIDI channel which has been preselected to contain chord root notes and which is the root note of the desired chord. Upon recognition of a root note, the processor will then calculate a three-note chord using the particular root note as its base, and will produce a three-note MIDI output message, on line 21. This output MIDI message will then be sent to the music sequencer 17 (through the merger device 16) which will result in the sequencer adjusting its musical accompaniment pattern to harmonize with the selected chord type.

If, for example, an accordion is the source instrument, operation of selected bass buttons on the instrument will result in MIDI signals representing those bass notes being produced and transmitted to interface 13. When a valid root bass note for a chord is recognized simultaneous with or following operation of the strobe switch 15 indicating a particular selected chord (major, minor, etc.), the complete MIDI message for the selected three-note chord is produced and transmitted to the music sequencer 17. The bass notes from the source instrument 11 are part of a more complicated MIDI data stream which includes MIDI signals. In this particular case, it is those notes in the MIDI stream which are coded to indicate that they are assigned to a specific MIDI channel that the present invention will be scanning, i.e. bass notes. The processor will be looking particularly for those bass notes which are root notes for chords. With other types of source instruments, other types of single musical notes can be used. In the accordion, it is bass notes which are used.

With the above general description in mind, reference is now made again specifically to FIG. 1, which shows microprocessor 19 responsive to signals from interface circuit 13. Interface circuit 13 signals microprocessor 19 that a MIDI character has been received from the source instrument, or that a selection switch has been operated. The MIDI data is transmitted to microprocessor 19 over receiving line 18, while the selection switch information is applied over one of a plurality of switch lines, shown as one unit at 22. Microprocessor 19, upon receipt of a signal on one of the switch lines 22, will immediately search for a valid bass root note in the MIDI data stream on line 18, and if one is found will produce a MIDI message representing a three-note chord corresponding to the particular switch operated, including the valid root note. When this is complete, microprocessor 19 indicates to interface circuit 13 that it has data to transmit and activates transmit line 21. The MIDI data is then transmitted to interface 13 and from there as an output MIDI message to music sequencer 17.

The tempo or speed of the music produced by the music sequencer 17 in response to the MIDI output message is controlled by a MIDI clock 27, which is adjustable by a variable resistor 29. The tempo can be adjusted by the operator through the pedal switch, or a slider attachment. MIDI clock 27 further drives a separate visual display unit 31, which indicates the "speed" of the resulting musical accompaniment in beats per minute. MIDI clock 27 also produces interrupt signals to the microprocessor 19 on interrupt line 33. This is explained in more detail in connection with FIG. 4.

The system of FIG. 1 also includes a number of option switches 35. The option switches are used to preselect a particular MIDI channel number for the various input signals as well as the channel number for the output message, and for selecting certain operating parameters, such as the range for acceptable input chord root notes and note offset values for the output chord notes. RAM memory 37 is used for temporary storage for program execution and for various calculations, while ROM memory 39 contains the software program itself. Microprocessor 19 operates via bus 41 relative to the option switches 35, the RAM and ROM memories and the interface circuit 13.

Figure 2:
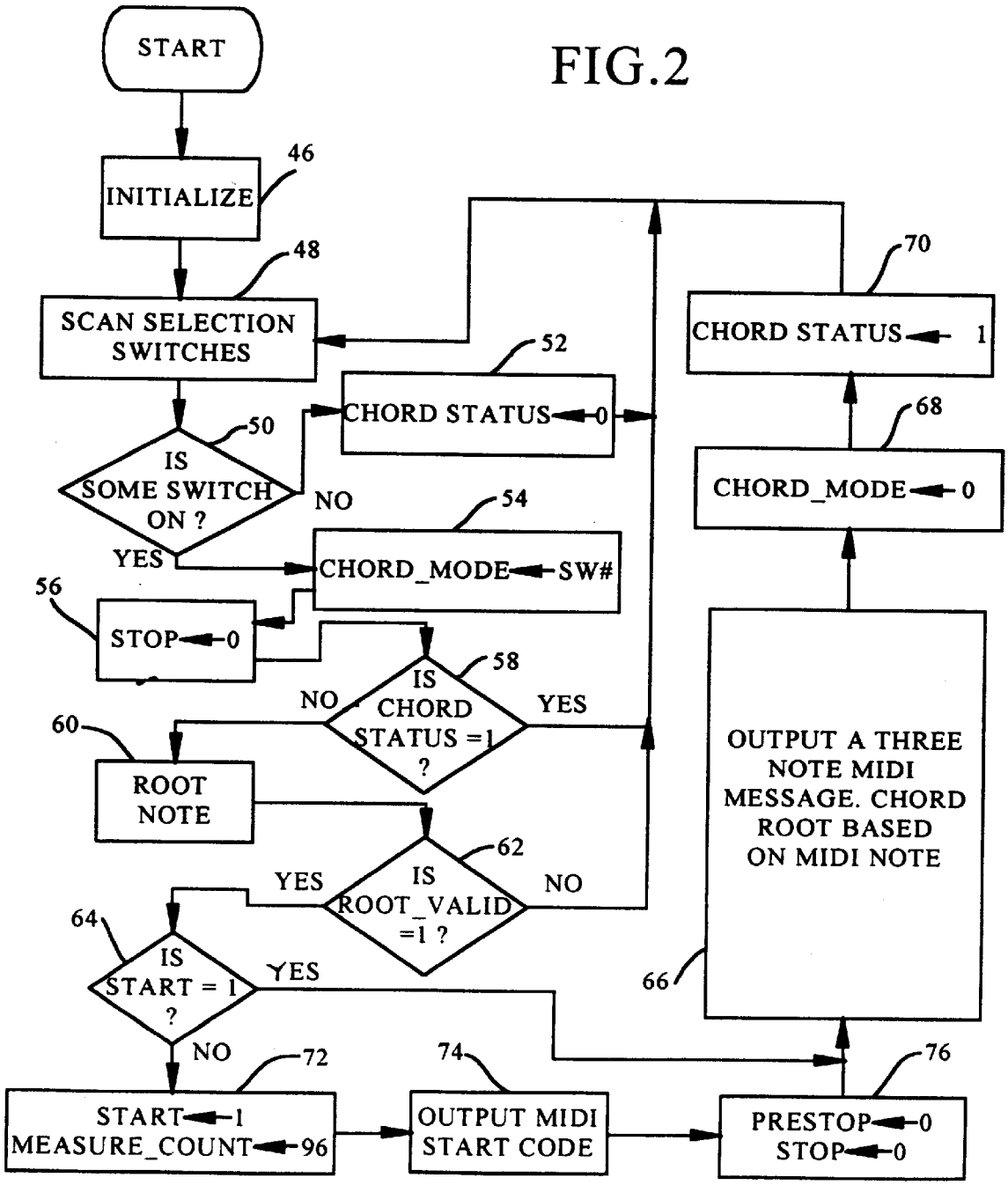
FIG. 2 is a software flow chart showing the general sequence of operation of the system of FIG. 1.

FIG. 2 shows a basic flow chart for the system of the present invention. In an initialize step 46, option switches 35 are read and the various software registers and interface circuits are preconditioned. This occurs prior to startup of the program.

Figure 4:
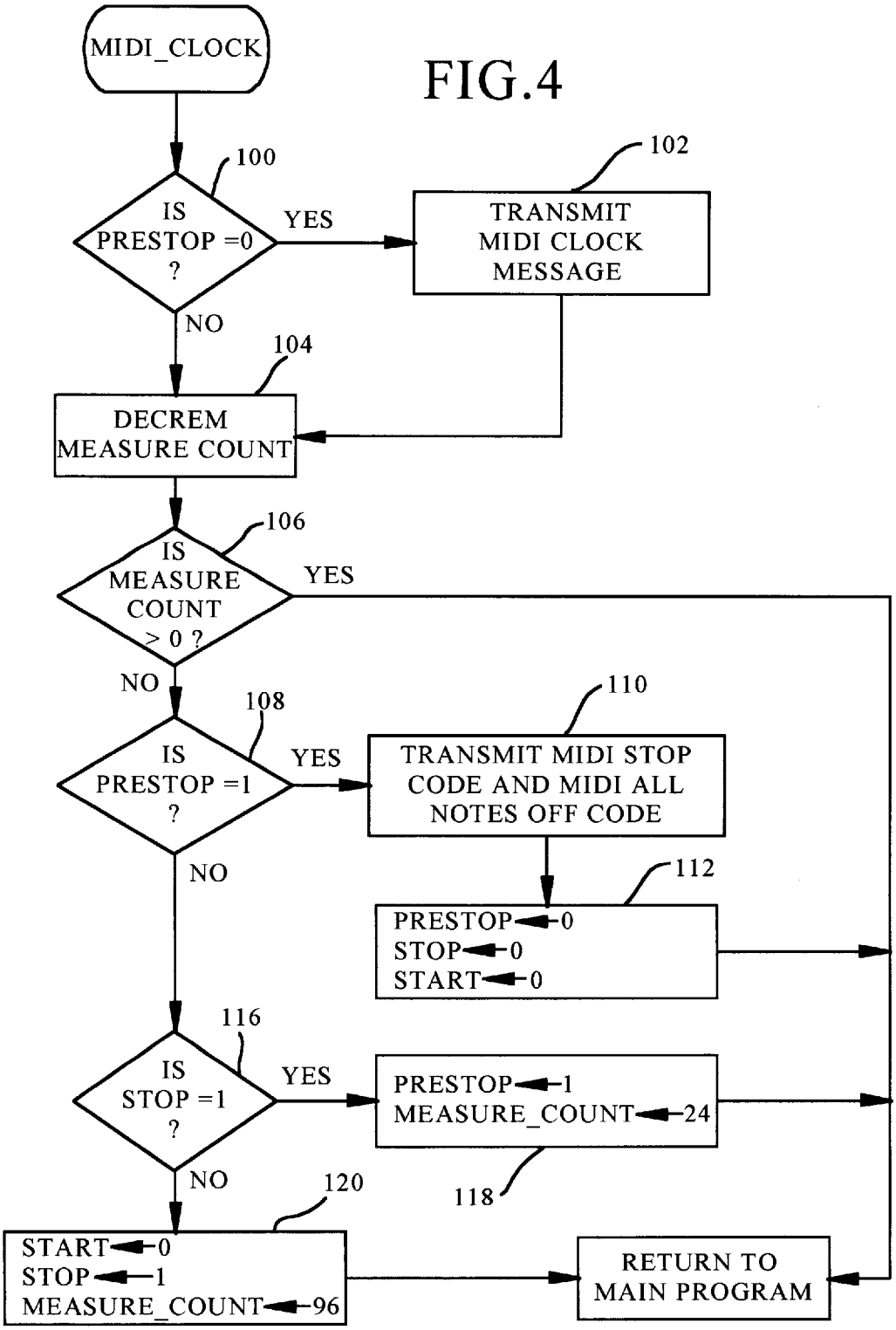
FIG. 4 is a software flow chart showing a detailed sequence of operation for another portion of the flow chart of FIG. 2.

Following initiation, in step 48, the selection switches in the strobe assembly are scanned. In FIG. 2, following step 48, the program includes various branches which eventually loop back to step 48. The program sequence is synchronized with the operation of the music sequencer by periodic interrupts of the program. In the embodiment shown, the program is interrupted by MIDI clock 27 96 times during each music measure. When an interrupt signal occurs, the operation of the program is suspended until the interrupt subroutine is completed. The interrupt subroutine is shown in FIG. 4 and is described below.

Referring again to FIG. 2, step 50 determines whether a selection switch (in switch assembly 15) has been operated, following the scanning of the switches. Again, in the present invention, this could be a major, major 7th, minor or minor 7th chord. In step 52, a "chord status" flag is set to zero and the program loops back to step 48 if no selection switch has been operated. If a selection switch has been operated, then a "chord mode" flag at step 54 is set to indicate which selection switch has been operated. Chord mode flags 0–3 represent the four chords possible with the present invention. Flag 0 represents a minor 7th chord, flag 1 represents a minor chord, flag 2 represents a major chord and flag 3 represents a major 7th chord. If more chords are available, then additional mode flags are used.

In step 56, a software "stop" flag is then set to zero as a result of step 54. The sequence thus continues. In step 58, the condition of the chord status flag (see step 52) is scanned. If the flag is one, the program loops back to step 48, because a one in the chord status flag indicates that subsequent program steps have been previously executed for the particular chord type indicated by the chord mode flag, and that the particular selection switch previously operated for that chord type (for which the program steps have been accomplished) has not yet been released. Hence, the musical pattern being produced by the sequencer at that point in time will continue to be in harmony with the selected chord type (and the recognized chord root) until the operated selection switch is released.

On the other hand, if the chord status flag is zero, indicating that a selection switch has just been operated and that the program has not been previously sequenced through for that type of chord, the music sequencer should now receive new MIDI chord data to produce accompaniment music in that new chord. This MIDI data is produced via a particular subroutine, shown at step 60. In this subroutine, which is shown in more detail in FIG. 3 and discussed in more detail below, the MIDI data stream from the source instrument is scanned to look for a chord root note character. The root note is in a MIDI message from the source instrument which includes the MIDI note number and the MIDI channel number. In the present embodiment, bass notes produced by bass buttons on an accordion are assigned to MIDI channel two. However, the apparatus can be preset to search for other channels by operation of option switches 35. The subroutine is thus intended to discover a root note for a chord to be produced in the MIDI signal stream from the source instrument.

Upon completion of the step 60 subroutine, step 62 determines whether or not the root note identified in step 60 is within the range of valid bass notes, as established by option switches 35. If the root note is invalid, then the program will loop back to step 48. If the root note is valid, then the remaining steps in the program are executed.

In step 64, the condition of a "start" flag is scanned. If the start flag is one, this means that a music measure of the music produced by the sequencer 17 is in progress. The program will then move to step 66, in which the actual three-note MIDI chord message, using the root note earlier determined, is calculated. The complete MIDI message is then transmitted to interface 13 and then to the music sequencer. In steps 68 and 70, the chord mode flag is set to zero and the chord status flag is set to one, which indicates that a MIDI message for the selected chord type has been transmitted. As long as the same selection switch remains operated, steps 60, 62, 64, 66, 68 and 70 will be bypassed in subsequent program sequences.

If the flag in step 64 is zero, this indicates that the music sequencer has completed a measure or has not started following its last stoppage. In step 72, a measure counter is therefore pre-set to 96, which is the number of MIDI clock pulses for one music measure. In step 74, a MIDI start signal is transmitted to the sequencer, while in step 76, the "pre-stop" and "stop" flags are both set to zero and program steps 66, 68 and 70 are executed, as previously described.

Figure 3:
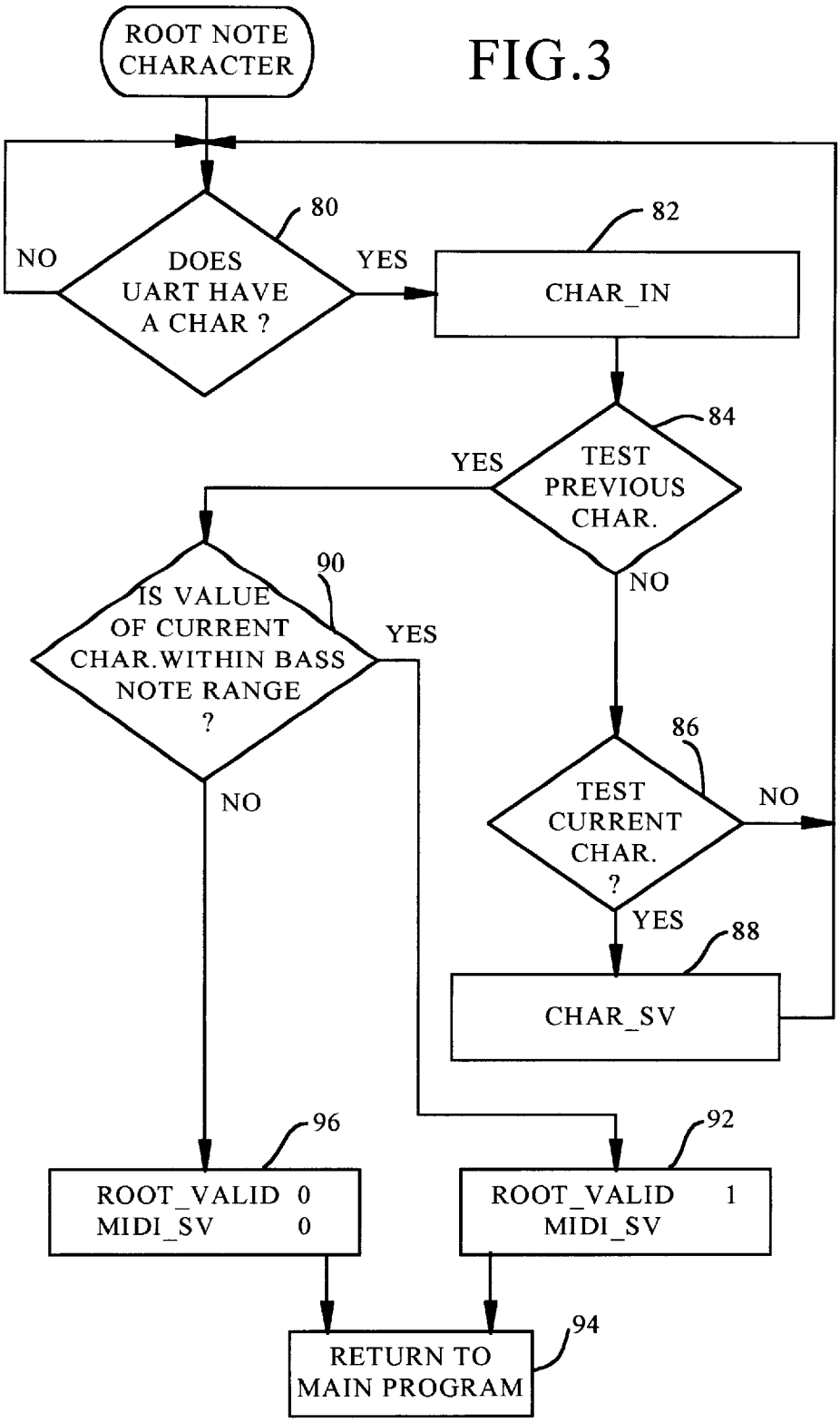
FIG. 3 is a software flow chart showing a detailed sequence of operation for a portion of the flow chart of FIG. 2.

Referring now in detail to FIG. 3, the routine of step 60 will loop back on itself until it receives a MIDI message the first portion of which includes the proper channel and an indication of "note on". The second portion of the message is a representation of the note within the accepted range of bass notes.

In step 80, the program checks interface 13 until the UART (universal asynchronous receiver transmitter) portion of the interface has a MIDI character therein. The character is then saved in an input register in step 82. The character just previously saved is evaluated in step 84 to see whether that previous character includes an indication of "note-on" and a proper channel number (e.g. channel 2). If not, then the current saved character is evaluated, at step 86. If the proper indications are not present in the current character either, then the routine loops back to step 80.

If step 86, on the other hand, determines that the current character indicates both note-on and a proper channel number, then, as shown in step 88, a save register is loaded with that character and the routine loops back to step 80 for the next character, which will be the numeric value of the note.

If the previous character was found to include a note-on indication and a proper channel number (step 84), then in step 90, the current character is tested against an acceptable range, and if it meets that requirement, then the current character is saved in a MIDI save register at step 92, with an indication that the root note of the current character is valid. The subroutine thereafter returns to the main program at step 94. If the current character is outside of the established limits, then the MIDI save register is set to zero, with an indication that the root note of the current character is not valid. The subroutine then returns to the main program.

FIG. 4 shows a software flow chart for the interrupt routine. The interrupt routine occurs in the embodiment shown each time that the MIDI 27 clock produces a pulse. In the embodiment shown, this means that 96 times during each music measure, the main program is interrupted, causing microprocessor 19 to transmit a timing message to the music sequencer 17. The rate of interrupt and the resulting clock message rate both comply with conventional MIDI timing specifications.

Although the MIDI clock interrupt routine can be used to control the tempo of the external sequencer, its primary purpose is to provide automatic starting and stopping of the sequencer and also to bridge the brief time gaps when the apparatus is changing from one type of chord to another (by means of the selection switches). This results in a smooth transition for chord changes and also results in the sequencer coming to a natural sounding smooth stop when the selection switches are all off.

At step 100, the subroutine queries a software "pre-stop" flag to determine whether or not it is zero. If it is zero, which means that the sequencer is not to be stopped and should continue to receive clock messages, and then in step 102, a MIDI clock message is transmitted to the sequencer. The MIDI clock message is transmitted to the music sequencer so that the operation of the apparatus and the sequencer continue to be synchronized. This is beneficial because the apparatus will thus always know the present point of operation of the music sequencer in a music measure. In step 104, a measure counter is decremented each time the interrupt occurs, regardless of the status of the pre-stop flag.

In step 106, if the measure counter is greater than zero, then the subroutine ends and control is returned to the main program. This would occur, for instance, when the music sequencer is operating (providing music), and there is no reason to change the chord being produced.

If, however, in step 106, the measure counter is zero, then step 108 looks at the pre-stop flag again to determine whether or not the pre-stop flag is set to one. If the pre-stop flag is now set to one, the sequencer is to be stopped. The stop sequence is initiated at step 110, during which two MIDI messages are transmitted to the sequencer 17. The first message is a MIDI stop message, while the second is a MIDI all-notes-off message. In step 112, the pre-stop, stop and start flags are all set to zero. The sequence then exits to the main program.

On the other hand, in step 108, if the pre-stop flag is zero, then in step 116, the stop flag is checked. If the stop flag is equal to one, then a sequence of steps will begin to bring the sequencer to a natural sounding halt. In step 118, the pre-stop flag is set to one and the measure counter is loaded to a value of 24, which is the count value for one-quarter of a measure. This can be varied, depending upon the desires of the operator. A 24 count allows the sequencer to run for an additional one-quarter measure before a stop code is transmitted to the sequencer. In addition to a smooth-sounding stop sequence, the extra quarter measure allows the operator a quarter measure margin to hit another selection switch. This arrangement prevents accidental stops and jerky restarts, which result from failing to operate a selection switch at precisely the start of beat one of a measure. The subroutine then returns to the main program.

If the stop flag in step 116 is zero, then at step 120 the start flag is set to zero, the stop flag is set to one, and the measure counter is set to 96 (a full measure).

Accordingly, the present invention is an intermediate controller apparatus which is functionally positioned between the primary controller, such as a music instrument, and a music sequencer. The intermediate controller produces MIDI signals for generating a chord, upon initiation of a selection switch and a simultaneous or subsequent operation of a single key or button on the primary controller, which produces a single note MIDI signal. The single note MIDI signal forms the root note of the resulting chord. Typically, the root note must be within a pre-specified range to be valid. In an accordion implementation, the single key is a bass note key on the instrument, which is usually operated at the start of a music measure.

Although a preferred embodiment of the invention has been disclosed herein for illustration, it should be understood that various changes, modifications and substitutions may be incorporated in such embodiment without departing from the spirit of the invention, which is defined by the claims which follow:

What is claimed is:

1. A controller apparatus for generating MIDI chord signals for use by a music sequencer apparatus, comprising:

music instrument means for producing, in MIDI format, a plurality of musical notes played by an operator on a musical instrument, including a series of chord root musical notes assigned to a selected MIDI communication channel from the musical instrument;

means for selecting a type of chord to be generated and generating a selection signal representing the chord type;

means responsive to the selection signal and a valid chord root musical note on said selected communication channel, said valid root musical note being generated no earlier than the selection signal, to produce a MIDI message representing a preselected desired chord which has the valid musical note as a root note; and means for transmitting the MIDI message to a music sequencer apparatus for generation of a selected musical pattern in the desired chord as an accompaniment to said musical notes from the musical instrument.

2. An apparatus of claim 1, wherein the MIDI message producing means is responsive to the first root musical note generated simultaneously with or shortly after operation of the selecting means.

3. An apparatus of claim 1, including means for interrupting the operation of the controller apparatus at successive intervals of time in order to synchronize the operation of the controller apparatus with the music sequencer.

4. An apparatus of claim 3, wherein the synchronization means includes a clock pulse generator for generating the interrupt signals at selected time intervals.

5. An apparatus of claim 4, including means for controlling the tempo of the accompaniment by varying the time interval of the clock interrupt signals.

6. An apparatus of claim 5, including means for displaying the tempo rate.

7. An apparatus of claim 1, wherein the types of chords are minor, major, minor 7th and major 7th.

8. An apparatus of claim 1, wherein the musical instrument is an accordion.

9. An apparatus of claim 8, wherein the plurality of musical notes are bass notes produced by operation of bass note buttons on the accordion.

10. An apparatus of claim 1, including means for continuously scanning the condition of the switch means and means permitting the sequencer to continue producing musical patterns in the desired chord associated with a previously operated switch as long as said switch continues to be operated.

* * * * *